United States Patent [19]

Richards

[11] Patent Number: 4,499,347

[45] Date of Patent: Feb. 12, 1985

[54] FLUID-FLOW-CONTROL-SWITCH VALVE

[76] Inventor: Gary H. Richards, 3204 Palm Ave., Manhattan Beach, Calif. 90266

[21] Appl. No.: 543,079

[22] Filed: Oct. 18, 1983

Related U.S. Application Data

[63] Continuation-in-part of Ser. No. 342,382, Jan. 25, 1982, abandoned.

[51] Int. Cl.[3] ..... H01H 35/40

[52] U.S. Cl. ..... 200/81.9 M

[58] Field of Search ..... 200/81.9 R, 81.9 M, 200/81.9 HG, 82 C, 82 F, 83 L, DIG. 31

[56] References Cited

U.S. PATENT DOCUMENTS

| | | | |
|---|---|---|---|
| 2,103,747 | 12/1937 | Hamilton et al. | 200/81.9 M |
| 2,887,546 | 5/1959 | Hatfield et al. | 200/83 L X |
| 3,368,045 | 2/1968 | Harper | 200/81.9 M |
| 3,559,197 | 1/1971 | Jarvis et al. | 200/81.9 M X |
| 3,562,455 | 2/1971 | McQueen | 200/81.9 M |
| 3,718,788 | 2/1973 | Roth et al. | 200/81.9 R |

*Primary Examiner*—J. R. Scott

*Attorney, Agent, or Firm*—Francis X. LoJacono

[57] ABSTRACT

A fluid-flow-control-switch valve having a body structure defined by an elongated tubular housing forming a flow passage, and an integrally formed, sealed, switch compartment containing a switch which is operated remotely from the flow passage by a magnetic flap member hingedly supported in the switch compartment, and positioned to engage the switch when the magnetic flap valve of the one-way-valve device is actuated by the flow of fluid through the flow passage.

5 Claims, 6 Drawing Figures

FLUID-FLOW-CONTROL-SWITCH VALVE

CROSS-REFERENCE TO RELATED APPLICATION

This application is a continuation-in-part of application Ser. No. 06/342,382 filed Jan. 25, 1982 now abandoned, by the same inventor as in the present application and having the same title.

BACKGROUND OF THE INVENTION

1. Field of the Invention

This invention relates generally to a flow-control valve, and more particularly to a fluid-flow-control-switch valve which includes a switch mechanism operated by a pair of magnetic members wherein one member further defines a check valve.

2. Description of the Prior Art

It is well known in the art that various problems and difficulties are being encountered in providing a suitable means to operate and control devices or mechanisms associated with fluid-flow systems.

Many different types of control devices are being used to open, close or divert electric circuits that must be used in conjunction with the various fluid-flow systems, such as electrical circuits to operate other motors or pumps within or without the basic flow system. However, these devices have features that restrict their use, and they are very often complicated to install and operate within any given fluid-flow system. Also, many of these devices are very expensive to employ, particularly with simple flow systems, such as those associated with swimming pools and spas (otherwise known as "hot tubs") wherein the systems include pumps for water, pumps for air, and back-up pumps, as well as controlled heating units.

SUMMARY OF THE INVENTION

The present invention has been designed to overcome the known problems as hereinbefore described, as well as many other problems related to fluid-flow-control systems.

One object of the invention is to provide a fluid-flow-control-switch valve having in combination a check-valve arrangement incorporated therein. The valve body of the device is formed having a longitudinal passage or conduit in which a valve seat and a valve flap are disposed, and an integrally sealed switch compartment in which a switch is located remotely from the flow passage.

Still another object of the invention is to provide a flap-valve member having a magnetic condition, whereby the movement of the flap valve will affect a secondary magnetic member within the sealed compartment, so as to engage and activate the switch.

A further object of the invention is to establish a one-way valve therewith, the magnetic-flap valve being hingedly connected to the valve seat at one open end thereof in order to prevent back flow.

A still further object of the invention is to provide a valve of this character that can operate various circuits or associated elements under varied conditions due to the flow of fluid passing through the valve.

It is another object of the invention to provide a valve device of this character wherein the remote magnetic member is activated by the magnetic flap valve as the flap valve is moved to an open position during fluid flow through the valve passage, and wherein the movement of the magnetic member includes a means by which the remote member can be adjusted to respond to the movement of the magnetic flap valve. Thus, an infinite number of switch-activating settings can be established.

It is still another object of the invention to provide a valve device of this character that can be used to open, close or divert an electric circuit which is basically activated by the flow of a fluid or a gas, and wherein the switch has no mechanical seal to break down and cause a leak between the valve-flow passage and the switch compartment.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes.

DESCRIPTION OF THE PREFERRED EMBODIMENT

Figure 1:
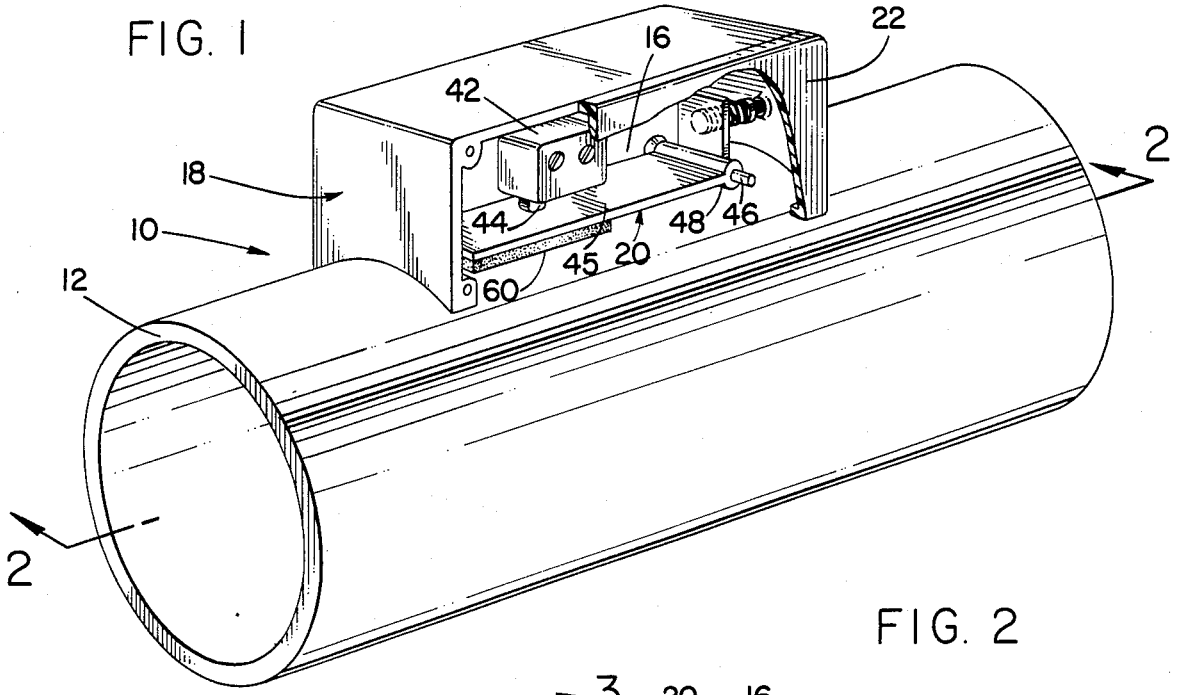
FIG. 1 is an enlarged perspective view of the present fluid-flow-control-switch valve, with the side wall of the switch compartment broken away.

Referring more particularly to the drawing, there is shown a fluid-flow-control-switch valve, generally indicated at 10, which comprises an elongated tubular body 12 defining a conduit or flow passage 14. Tubular body 12 is further provided with an integrally formed sealed chamber or compartment 16 defined by a substantially rectangular housing 18. As will be understood from the foregoing description, compartment 16 is sealed from flow passage 14 wherein a switch means, indicated generally at 20, is located.

It is contemplated that the combined structure of the valve will be preferably made from a plastic material, whereby the tubular structure and the housing can be formed as a single unit, either split-molded or (as shown) with the housing 18 having a removable side-wall cover 22.

Figure 2:
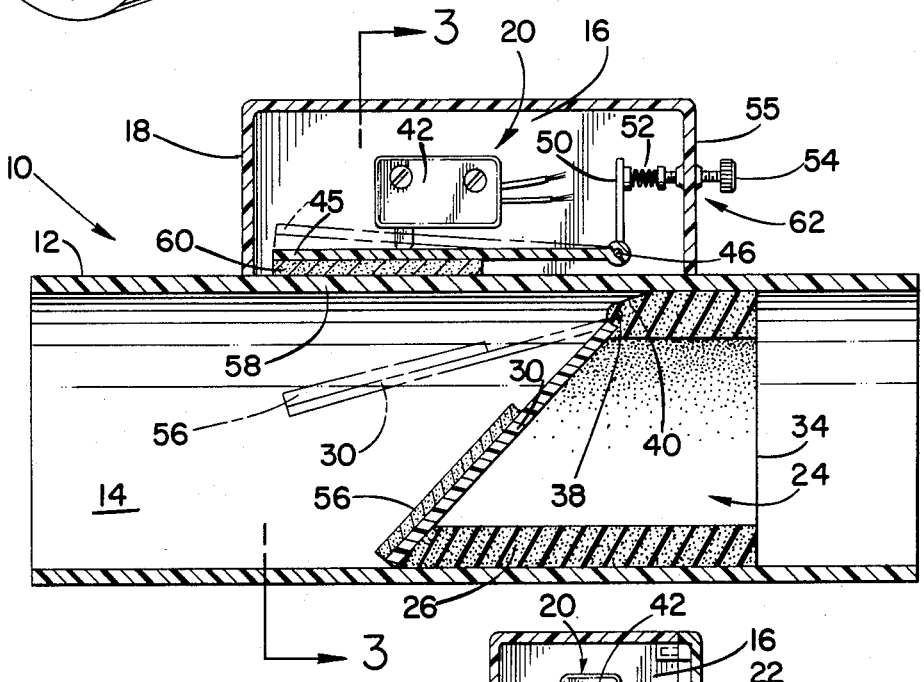
FIG. 2 is a longitudinal cross-sectional view of the valve structure taken substantially along line 2—2 of FIG. 1.
Figure 3:
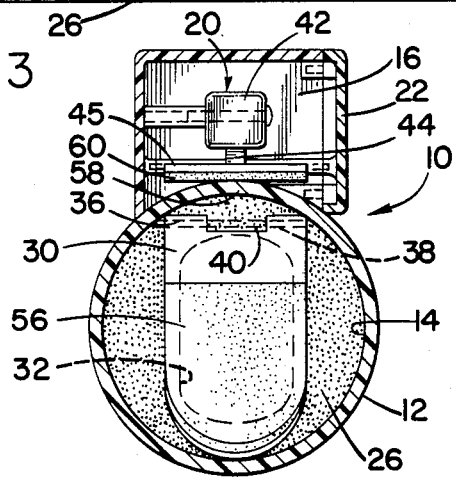
FIG. 3 is a transverse cross-sectional view of the valve taken substantially along line 3—3 of FIG. 2.

Mounted within flow passage 14 is a one-way-valve means, generally designated at 24, which comprises a valve-seat member 26 adapted to be securely mounted in passage 14. The valve seat is formed having an outer diameter equal to the inner diameter of flow passage 14, and including a central bore 28 which will have an annular configuration, so as to be fully covered when flap valve 30 is in a closed position. That is, when flap valve 30 rests against the outlet opening 32, it prevents back flow of any down stream fluid or gas. The outlet opening is preferably disposed at a slant or inclined position, so as to provide a more positive seal, since the weight of the flap valve will be normally used to close the valve when there is no fluid flow. However, various biasing means (not shown) could be employed to establish direct seals for some particular applications. The inlet opening 34 of seat 26 is preferably formed in a vertical arrangement, as seen in FIG. 2.

Accordingly, flap valve 30 is hingedly connected to valve-seat member 26 above opening 32. The flap valve 30 is shown as having a hinged end 36 through which hinge pin 38 is positioned, thus connecting the flap valve to the hinge ear 40 formed on valve seat 26. Again, however, the hinging means can also be provided by forming flap valve 30 as an integral part of the valve seat, as is often the case when using plastic or rubber materials. Hence, using either hinging arrangement for flap valve 30, the valve can pivot upwardly from a fully closed mode to a fully open mode, or to any various other open degrees therebetween. (See FIG. 2.)

Referring now to the switch means 20, which is located remotely from flow passage 14 in compartment 16, the switch means comprises a switch member 42 secured in compartment 16 and has a suitable switch button 40, which is positioned so as to be engaged by a second flap member 45. Flap member 45 is hingedly mounted in compartment 16 by means of transverse pin 46. Various hinging arrangements are contemplated; however, flap member 45 is shown as an elongated, substantially flat, tongue member adapted at one end thereof with a hinge eyelet 48 to receive pin 46 which is supported in the opposing side walls of the switch housing 18. The hinged end of flap member 45 includes means for adjusting the biasing tension placed thereon. That is, the pivoting movement of the flap member can be controlled by an extended shoulder plate 50 that is positioned to be engaged by a spring 52, the spring being interposed between shoulder plate 50 and an adjusting screw 54 which is threadably mounted to end wall 55 of housing 18.

Accordingly, in order to establish pivotal movement to flap member 45, a force must be applied which is accomplished by providing a magnetic force between compartment 16 and the passage 14. Thus, flap valve 30 is provided with a magnetic member 56; or, if required, the flap valve can be composed of a magnetic material—whereby any upward movement of flap valve 30 will cause a greater magnetic flux to pass through the annular passage wall 58, just under the oppositely disposed magnetic member 60 attached to flap member 45. Member 45 can also be composed of a magnetic material, if necessary.

In order to provide movement for the flap member 45, the opposing magnetic members will generally comprise like poles. Accordingly, the negative side of one magnet should face the negative side of the opposite magnet; or, the plus side of one magnetic should face the plus side of the opposite magnet. The closer magnet 56 approaches magnet 60, the greater the magnetic flux, whereby flap 45 will move so as to engage button 44 of switch 42.

However, it is contemplated that other switching arrangements can be incorporated therein, wherein the opposing magnetic members will be required to provide opposite but attracting forces.

It can be readily understood that the movement of flap 45 is adjustable by the adjusting means indicated at 62; and that switch 42 can be either a normally open or a normally closed type, depending upon the specific requirements.

As one example of where a pump is used in a fluid-flow system, the switch 42 would be arranged to shut off the pump to eliminate seal damage due to dry running of the pump, if the pump lost its prime. Thus, as long as there is a fluid flow, switch 42 is activated to run the pump. However, if fluid flow were to stop, flap valve 30 would close so as to shut off the pump, thus preventing back flow.

If two pumps are used in a system, one for back-up, the switch 42 would be arranged to switch on the back-up pump, if the primary pump failed—again preventing back flow.

Where a pump is used in conjunction with a heater, the switch would turn the heater on or off, depending upon whether or not there is a flow of fluid through the system.

Hence, there are various conditions under which the present invention can be employed.

ALTERNATIVE EMBODIMENT

Figure 4:
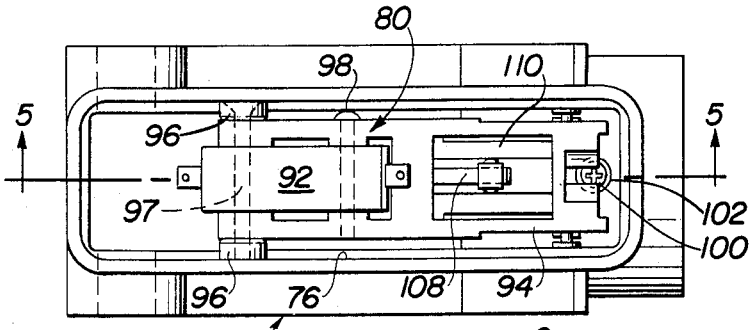
FIG. 4 is a top-plan view of an alternative arrangement of the present invention with the top cover removed to illustrate the control-switch mechanism.
Figure 5:
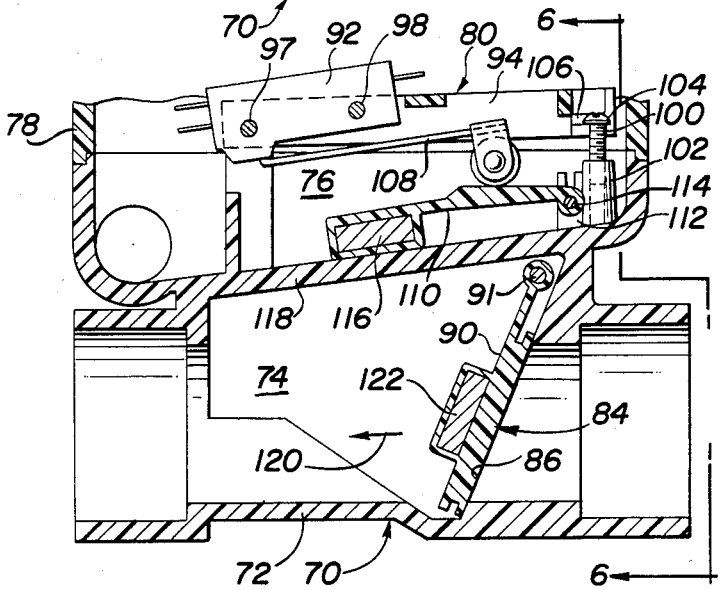
FIG. 5 is a longitudinal cross-sectional view of the fluid-flow-control-switch valve taken substantially along line 5—5 of FIG. 4.
Figure 6:
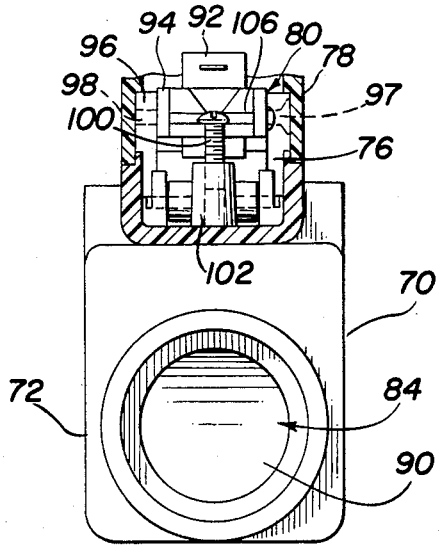
FIG. 6 is a partial cross-sectional view taken along line 6—6 of FIG. 5.

Referring now to the alternative embodiment shown in FIGS. 4, 5 and 6, there is shown a housing generally indicated at 70, defining an elongated body 72 which has a conduit or flow passage 74 in the lower section thereof and an integrally formed upper chamber or compartment 76. The compartment is provided with a removable cover 78 that defines a sealed housing in which is located a switch means, designated at 80.

As in the first embodiment 10, the valve structure will be made preferably from a durable material which is normally used for plastic pipes.

A one-way-valve means, generally indicated at 84 is mounted within flow passage 74. Valve means 84 comprises a valve-seat member 86 formed as an integral part of conduit 74. The valve seat is formed so as to be readily engaged and covered by a flap valve 90 when the valve is in a closed mode of operation. Thus, valve 90 rests against the angularly disposed valve seat 86, as seen in FIG. 5. Flap valve 90 is hingedly supported above valve seat 86 by pin 91, allowing flap valve 90 to pivot upwardly from a fully closed to a fully opened position, or any position therebetween.

Switch means 80, which is located in compartment 76 remotely from passage 74, comprises a switch 92 fixedly mounted to a pivotal carriage member 94 adjacent the pivotal end of the carriage member. Carriage member 94 is pivotally connected to side walls 94 of compartment 76 by a pin 97, which also passes through switch 92. The switch is further attached to carriage 94 by an adjusting means defined by a screw 98, whereby switch 92 is adjustable in an up or down location by means of a threaded adjusting pin 100. That is, the pin 100 is threaded into a boss 102 which is affixed to the valve housing, the head 104 of the pin 100 being rotatably mounted to the free end of carriage 94 that is formed having a slot 106 in which pin head 104 is mounted. Thus, as pin 100 is threaded up or down in boss 102, carriage 94 will be raised or lowered, causing switch 92 to move up or down.

Accordingly, the adjustable movement of switch 92 will determine the location of its switch arm 108 which is superposed over a second flap member 110, so as to engage the flap member along its length. The flap member is pivotally mounted at one end to slotted ears 112 by pin 114. The opposite end of flap 110 is provided with a magnetic member 116 that normally rests on the intermediate wall member 118 which divides compartment 76 from conduit 74, as seen in FIG. 5. The movement of flap 110 in an upwardly direction will force switch arm 108 to lift upwardly the activating switch 92.

Thus, as flow of liquid passes through conduit 74 in the direction of arrow 120, first flap valve 90 will be forced upwardly toward the underside of wall 118. A magnetic member 122 is affixed to flap valve 90 and is positioned thereon, so as to be aligned under magnetic member 116 in flap member 110. As magnet 122 approaches magnet 116 (each having like poles, face to face), flap member 110 will be forced upwardly against switch arm 108 and activate switch 92, as previously mentioned. The closer magnet 122 comes to magnet 116, the greater the magnetic flux. Hence, by adjusting the position of switch 92 by means of adjusting carriage 94, switch arm 108 will control the movement of flap member 110. That is, downward force of switch arm 108 against flap 110 will determine how high flap valve 90 must pivot to cause flap 110 to pivot upwardly. Therefore, switch 92 can be adjusted for activation at various degrees of liquid flow through conduit 74.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A fluid-flow-control-valve device, comprising:

a housing defining an elongated flow passage, and an integrally, formed sealed switch compartment;

a one-way-valve means positioned in said flow passage to allow fluid to flow in one direction through said flow passage, wherein said vlave comprises:

a valve seat mounted in said flow passage and having inlet and outlet openings;

a flap-valve member hingedly attached adjacent said valve seat and positioned over said outlet opening thereof, so as to allow fluid flow in one direction;

a first magnetic member affixed to said flap valve;

switch means located within said switch compartment;

a flap member hingedly mounted in said switch compartment and positioned therein to seat against the outside wall of the conduit portion defining a switch-compartment base, and adapted to pivot upwardly in a substantially parallel relationship within said fluid passage;

a second magnetic member forming at least part of said flap member and positioned thereon to be aligned with said first magnetic member of said flap valve, whereby said flap member is caused to move in engagement with said switch means when said first magnetic member is positioned adjacent said second magnetic member; and response-adjusting means adapted to control the responsive movement of said flap member and said switch means;

wherein said response-adjusting means comprises:

a shoulder plate affixed to said flap member;

a set screw adjustably mounted to said housing of said sealed compartment; and a spring interposed between said shoulder plate and said set screw, whereby adjustable force is applied to said flap member, in order to allow said flap valve to move to a predetermined open position before said flap member engages said switch.

2. A fluid-flow-control-valve device, comprising:

a housing defining an elongated flow passage, and an integrally formed, sealed switch compartment;

a one-way-valve means positioned in said flow passage to allow fluid to flow in one direction through said flow passage, wherein said valve means comprises:

a valve seat mounted in said flow passage and having inlet and outlet openings;

a flap-valve member hingedly attached adjacent said valve seat and positioned over said outlet opening thereof, so as to allow fluid flow in one direction;

a first magnetic member affixed to said flap valve;

switch means located within said switch compartment;

a flap member hingedly mounted in said switch compartment and positioned therein to seat against the outside wall of the conduit portion defining a switch-compartment base, and adapted to pivot upwardly in a substantially parallel relationship within said fluid passage;

a second magnetic member forming at least part of said flap member and positioned thereon to be aligned with said first magentic member of said flap valve, whereby said flap member is caused to move in engagement with said switch means when said first magnetic member is positioned adjacent said second magnetic member; and response-adjusting means adapted to control the responsive movement of said flap member and said switch means;

wherein said response-adjusting means comprises:

a carriage member pivotally mounted in said switch compartment, said switch means being affixed thereto for movement with said carriage;

means connected to said carriage to adjust said carriage and said switch means, whereby the movement of said flap member is controlled.

3. A fluid-flow-control-valve device as recited in claim 1, wherein said carriage-adjusting means comprises a threaded pin rotatably mounted in said carriage member and threadably attached to said housing.

4. A fluid-flow-control-valve device as recited in claim 1, wherein said carriage member includes a pivotal end and a free end, said pivotal end being mounted to said housing and said free end being adapted to receive said adjusting means.

5. A fluid-flow-control-valve device as recited in claim 4, wherein said switch means is attached to said carriage member adjacent the pivotal end thereof, and wherein said switch means includes an extended switch arm positioned to engage said flap member, whereby the adjustment of said carriage member determines the degree of engagement between said switch arm and said flap member.

* * * * *